United States Patent [19]

Moller

[11] 4,331,093

[45] May 25, 1982

[54] COMPOSITE WIND SURFBOARD

[75] Inventor: Jens T. T. Møller, Ørum, Denmark

[73] Assignee: Ten Cate Sports B.V., Almelo, Netherlands

[21] Appl. No.: 76,989

[22] Filed: Sep. 20, 1979

[30] Foreign Application Priority Data

Sep. 20, 1978 [DK] Denmark ..... 4154/78
Nov. 30, 1978 [DK] Denmark ..... 5369/78

[51] Int. Cl.[3] ..... B63H 9/04

[52] U.S. Cl. ..... 114/39; 114/352; 441/74

[58] Field of Search ..... 9/2 C, 2 S, 310 A, 310 B, 9/310 C, 310 E; 114/39; 280/12 H, 15, 18, 810; 403/341, 393, 405, 406, 407, 408

[56] References Cited

U.S. PATENT DOCUMENTS

| | | | |
|---|---|---|---|
| 3,104,888 | 9/1963 | Day et al. | 403/341 |
| 3,308,493 | 3/1967 | Lambach | 9/310 E |
| 3,501,181 | 3/1970 | Jureit | 403/406 |
| 3,960,460 | 6/1976 | Fischer | 403/406 |
| 4,100,870 | 7/1978 | Prade | 9/310 E |
| 4,130,292 | 12/1978 | Lorenz | 114/39 |
| 4,166,425 | 9/1979 | Kummetz | 9/310 E |

FOREIGN PATENT DOCUMENTS

| | | | |
|---|---|---|---|
| 2643221 | 4/1978 | Fed. Rep. of Germany | 114/39 |
| 912397 | 8/1946 | France | 403/405 |

*Primary Examiner*—Edward R. Kazenske
*Attorney, Agent, or Firm*—Hopgood, Calimafde, Kalil, Blaustein & Judlowe

[57] ABSTRACT

Two single surfboards (11, 12) are linked and assembled together in tandem fashion by a linking member (13) of elongated shape located underneath the two single surfboards (11, 12) and secured at one end thereof and the other end thereof, respectively, by clamps (23) traversing one single surfboard and the other single surfboard, respectively, in the keel boxes of the surfboards. Further clamping members (26) are located inbetween above mentioned clamps (23) and arranged for locking one end of one single surfboard and another end of another single surfboard on the linking member (13).

11 Claims, 16 Drawing Figures

Figure 1:
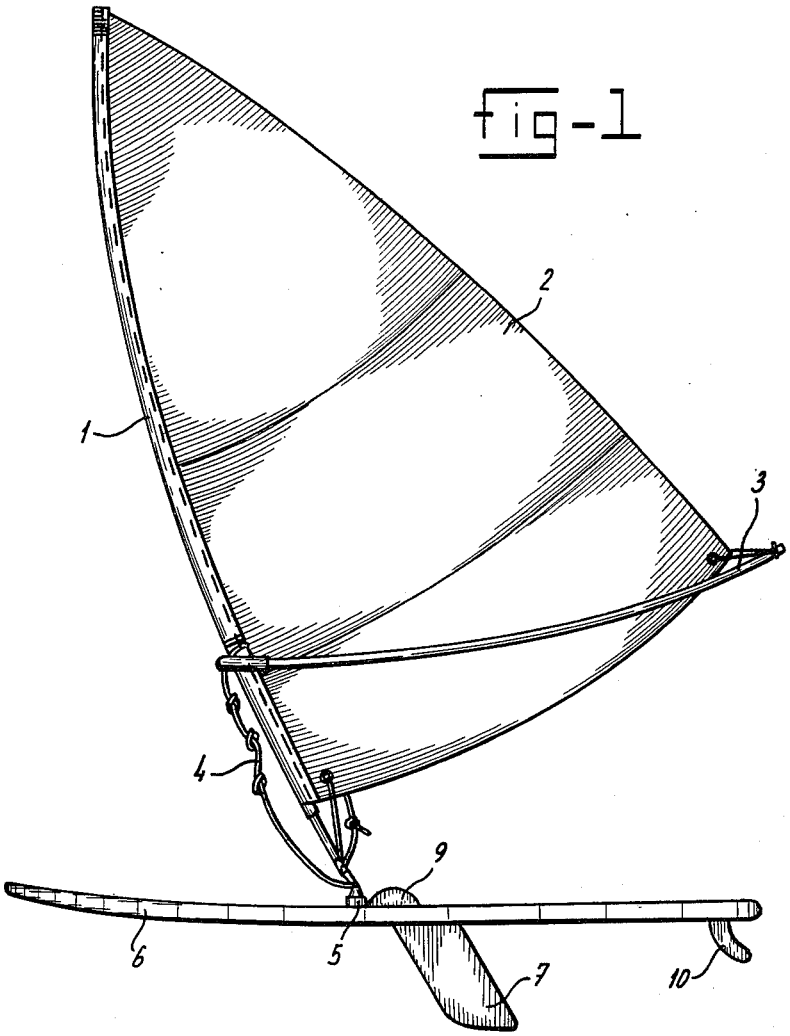

1
2
3
4
5
6
7
9
10

6
5
8

COMPOSITE WIND SURFBOARD

The invention is related to composite wind surfers comprising at least two single surfboards, each having a keel box and retractable keel, said surfboards being linked together.

Prior art composite wind surfers are known in which two surfboards for the purpose of being easily linked together for use or separated from each other for easy transport comprise mechanically complicated means for locking said two surfboards end to end. Such prior art design is known from U.S. Pat. No. 4,100,870 to Prade.

This prior art design implies strong mechanical elements rigidly fastened to each one of the two surfboards to be linked together, said mechanical elements comprising many different parts such as springs, bolts, dovetail joints. The assembling and disassembling of surfboards of above mentioned prior art design is cumbersome and implies that tools are disponsible at the time and place where the work is to be done.

Other prior art designs with collapsible surfboards are known, cf. e.g. U.S. Pat. No. 3,409,920 to Brownley and U.S. Pat. No. 3,996,868 to Schagan. A general problem in prior art wind surfers, no matter whether they are designed to be assembled in a composite surfer or to be assembled in single surfboards, is that these surfers encounter great stress in use, and that severe pounding and twisting forces require high solidity of assembly. At the same time, it is evident that users do not wish to be forced to use a lot of time in assembling and later on disassembling their surfers before and after use, respectively.

Accordingly, it is an object of the invention to provide a composite wind surfer which can be quickly assembled or disassembled without need for any special tool.

Another object of this invention is to provide a wind surfer able to sustain strong pounding and twisting forces with mechanically extremely simple and economical but, however, reliable and easily interchangeable or repairable means.

Another object of this invention is to provide a wind surfer in which no modification at all is imposed upon each surfboard for obtaining a composite surfer, whereby users already in possession of their surfboards only need to acquire simple mechanical means in order to be able to obtain composite surfers.

In accordance with the present invention a composite wind surfer is provided, comprising at least two single surfboards, each having a keel box and a retractable keel, characterized by surfboard rigid coupling means located under the surfboards and mechanically connected with each surfboard on at least two interspaced points of each of said surfboards.

The invention is mainly based on the consideration that instead of especially designing the surfboards for equipment with coupling means located in the very same plane as each of the surfboards to be assembled and thus demanding very high stress resisting or absorbing capability it is advantageous to couple the unmodified surfboards together by means of coupling means located under the surfborads, the coupling together of the two surfboards being thus made in vertical direction in relation to said surfboards instead of in their common horizontal plane.

Figure 2:
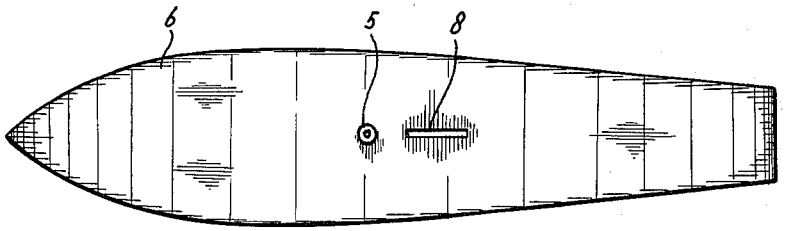
Figure 7:
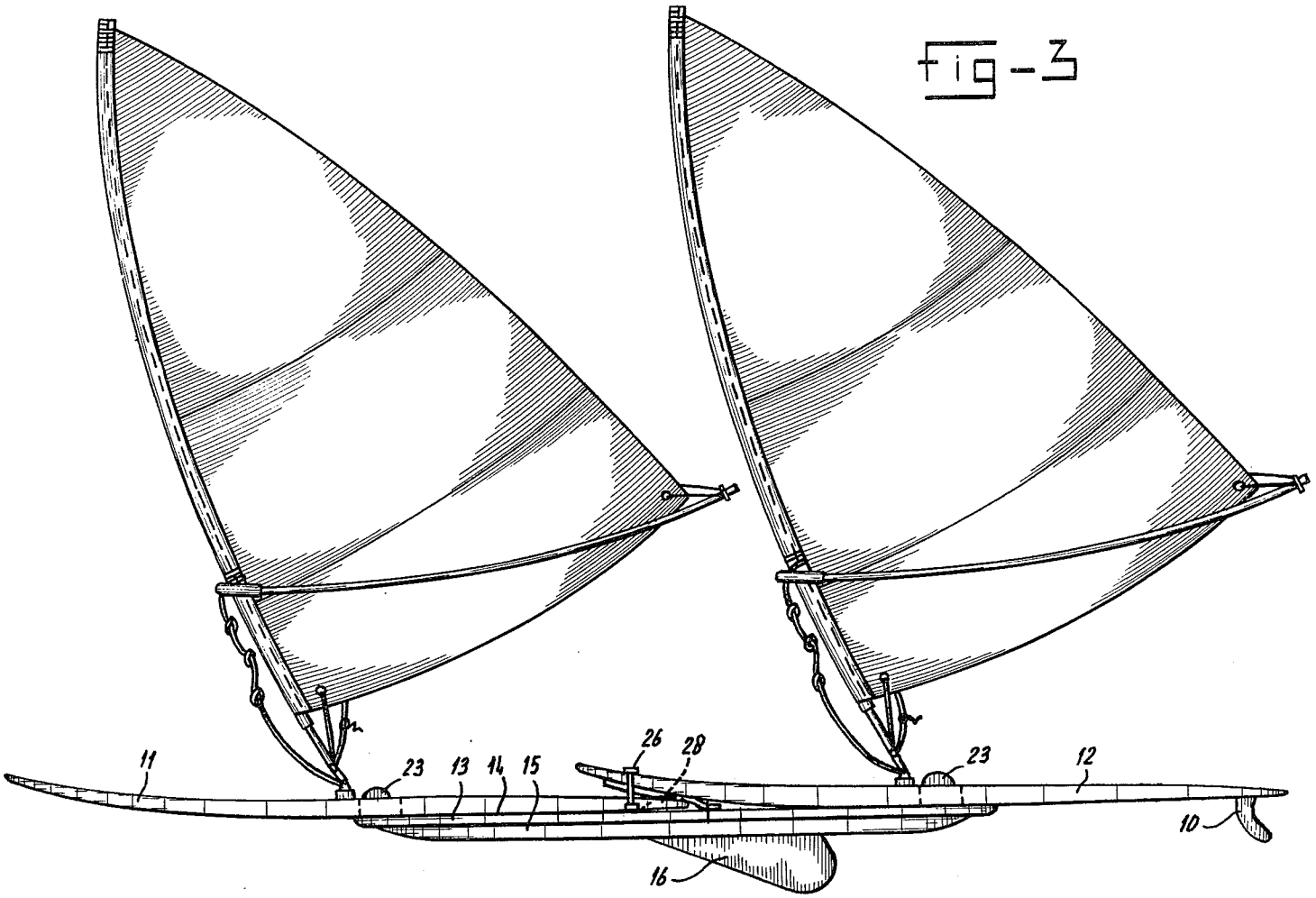
Figure 4:
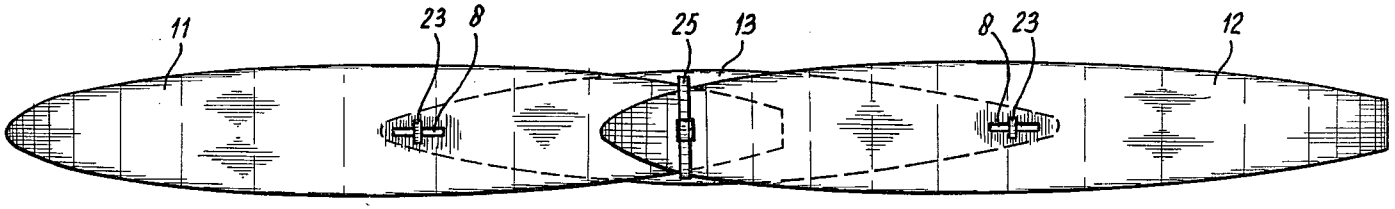
Figure 5:
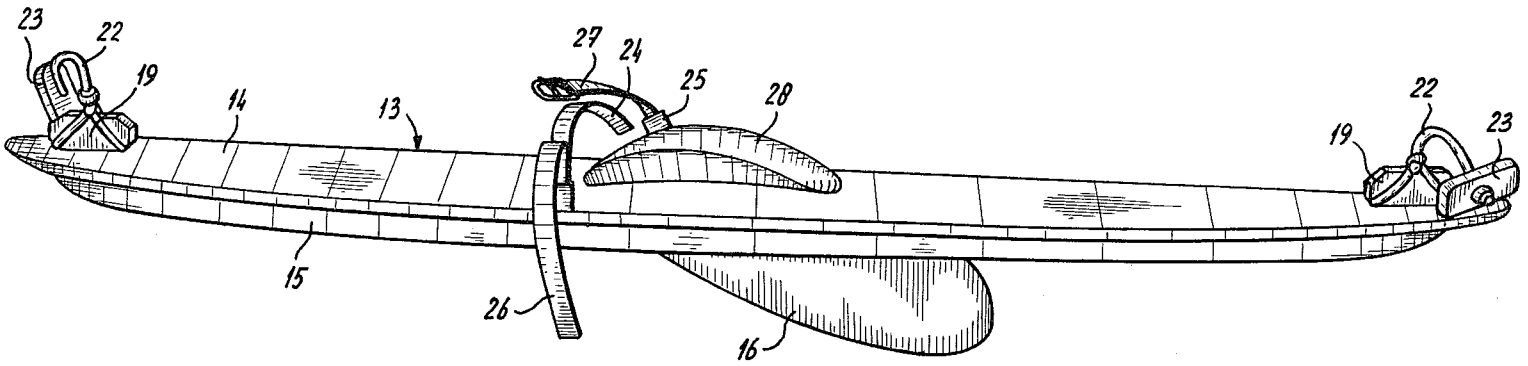
Figure 6:
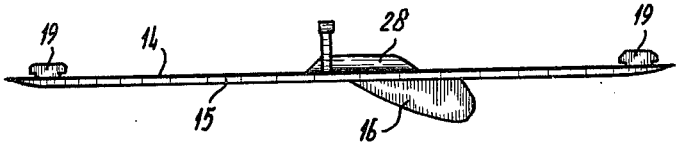
Figure 7:
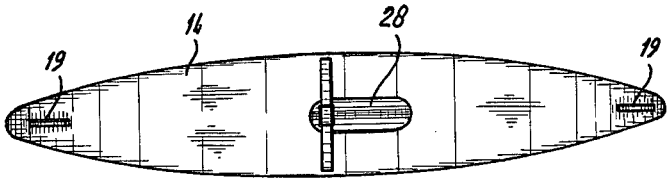
Figure 8:
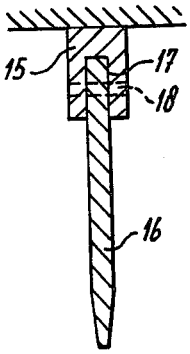
Figure 9:
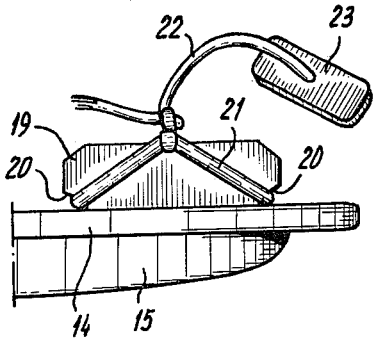
Figure 10:
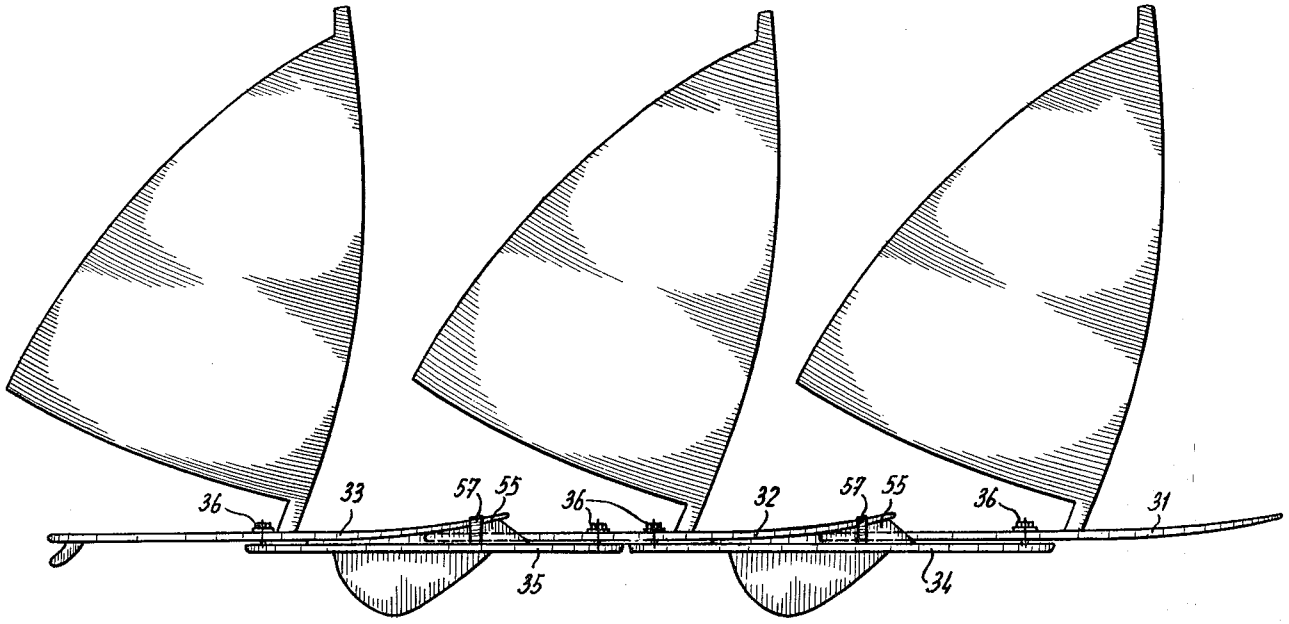
Figure 11:
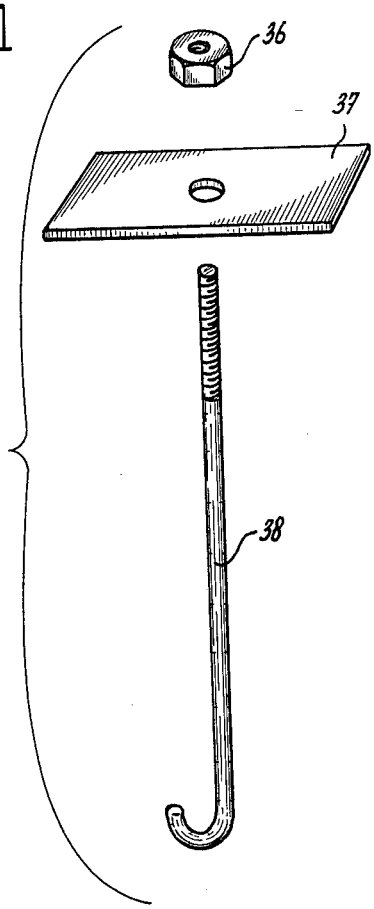
Figure 12:
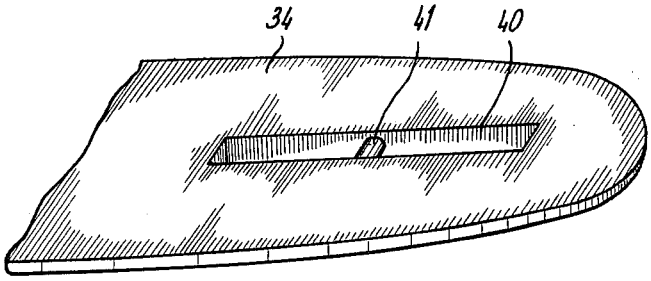
Figure 13:
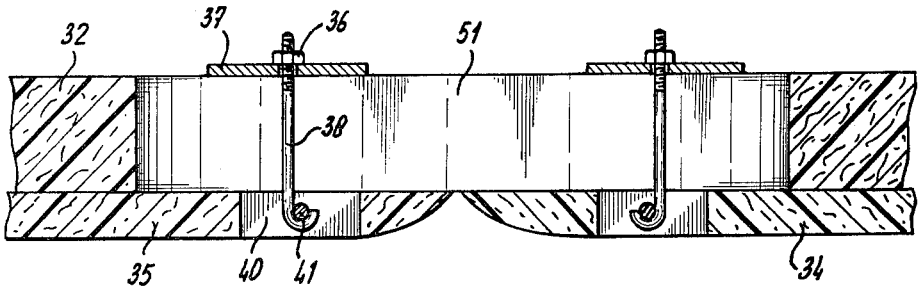
Figure 14:
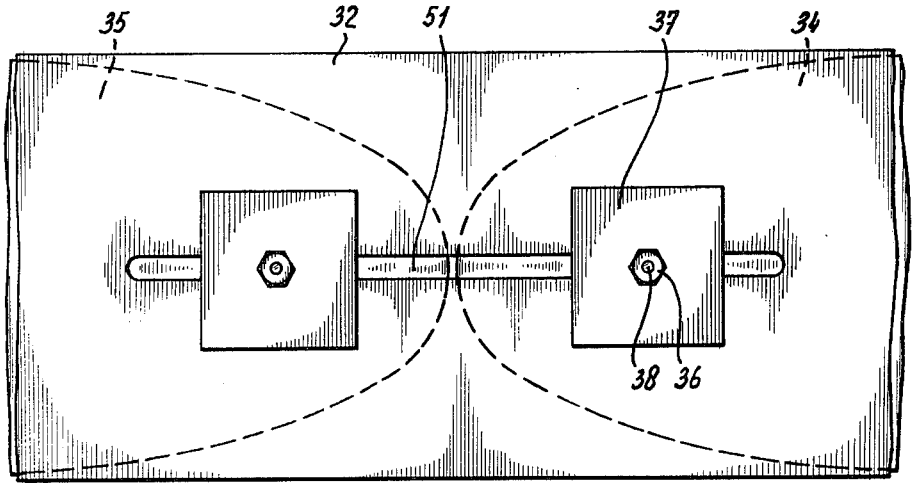
Figure 15:
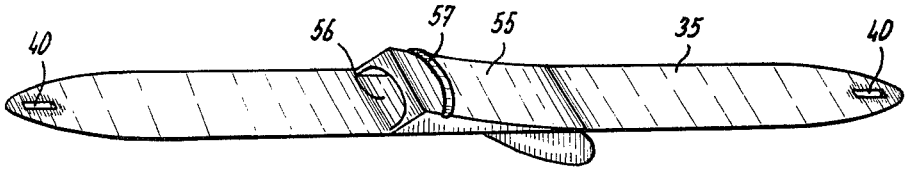

Other objects and attendant advantages of this invention will become more readily apparent and understood from the following detailed specification and accompanying drawing in which FIG. 1 is a side view of a conventional single surfboard, FIG. 2 is a plan view of the naked board seen from above, FIG. 3 is a side view of a composite surfer according to the invention and comprising two single surfboards, FIG. 4 is a plan view of two single surfboards coupled together, shown without masts nor sails, FIG. 5 is a perspective view of one embodiment of coupling means according to the invention, FIG. 6 is a side view of parts of the coupling means according to FIG. 5, FIG. 7 is a plan view of the coupling means according to FIG. 6, FIG. 8 shows a detail in keel assembly, FIG. 9 shows a detailed view of a part of the coupling means according to FIG. 5, FIG. 10 is a side view of a composite wind surfer with three single surfboards assembled together in accordance with the invention, FIG. 11 is a detail of coupling means, FIG. 12 shows a part of said coupling means, FIG. 13 is a longitudinal section through one surfboard and two coupling means, FIG. 14 is a top view of the assembly according to FIG. 13, FIG. 15 is a perspective view of an embodiment of coupling means for use in assembly according to FIGS. 10, 13, and 14, and FIG. 16 is a detail of part of coupling means according to FIG. 15.

FIGS. 1 and 2 show a wind-surfboard having a mast 1 of glass fibres, a sail 2, a forked boom 3 and an outhaul rope 4. The mast is attached to the surfboard 6 by means of a foot connection 5 consisting of an external shell of massive polyethylene and an internal filling of foam material.

The wind-surfboard comprises a daggerboard keel 7 which is located in an elongated opening 8, the daggerboard box, and fixed by means of securing means 9. At the rear end the surfboard comprises a stabilizing fin 10 secured to the surfboard by means of screws.

FIG. 3 illustrates how a tandem surfer according to the present invention can be obtained by assembling two single surfboards 11 and 12 by means of a coupling element 13. Said coupling element, shown in more details in FIGS. 5, 6, and 7, comprises an upper plate 14 of largest width in the middle and with tapered ends. The upper side of said plate is plane. The external surface of said plate can be made as a massive shell of epoxy-glass-fibres, while the interior of this shell is filled with foam material but, as an alternative, the plate can be made of massive glass fibres, massive wood such as waterproof plywood or any other convenient material.

On the under side of the plate 14 is affixed a longitudinal strengthening rib 15 centered on the central plane through the plate 14. The coupling element is designed with a keel 16 which can be inserted and adjusted in a slot 17 in the strengthening rib 15. Said keel can be secured in different predetermined positions by means of transversal pins 18 or in any other convenient way, the important feature being only that said keel can be positionally adjusted in the longitudinal direction of the coupling element.

The coupling element comprises clamping means at the front end, the rear end and the middle, respectively.

The clamping means at the front end and the rear end, respectively, are shown in FIG. 9. They comprise a plate element 19 of a thickness less than the transversal dimension of the daggerboard box 8. Said plate element is designed with two notches 20, in which a rubber ring 21 can be inserted. On the upper edge of the plate element 19, the two side portions of the rubber ring are bound together by means of a piece of rope 22, the end of which is inserted through a holding piece 23. The middle clamping means comprises two elastic straps or belts 24, 25, and 26, 27.

Said elastic belts can be tightened around the rear end of the front surfboard and the front end of the rear surfboard, respectively. Furthermore, a flexible element 28 of e.g. rubber is mounted on the plate 14 in the proximity of the middle clamping means.

As shown in FIG. 8, the keel 16 of the composite surfboard is positionally adjustable in the slot 17 in the strenghening rib 15 and can be secured in different positions by means of transversal pins 18.

When two surfboard users wish to combine their single-surfboards into a composite or tandem surfboard, said two single-surfboards can be assembled or coupled together by means of said coupling element.

For that purpose, the daggerboard 7 of each single-surfboard and also the rear fin 10 of one of said surfboards to be the front surfboard are dismounted. The holding piece 23 of the front clamping means is inserted upwards through the daggerboard box 8 of said front surfboard. The plate element 19 is pulled up through the daggerboard box and the parts are then clamped together by pulling the rubber ring 21 up through the daggerboard box 8 and then inserting the holding piece 23 under the rubber ring 21 and in abutment against the upper surface of the front single surfboard, cf. FIG. 3.

The straps or belts 24 and 25 are tightened around the rear end of the front single surfboard and the flexible element 28 is placed on the rear end of the front single surfboard.

Then, the rear single surfboard is coupled to the coupling element by inserting the rear clamping means up through the daggerboard box and clamping the parts together in the same way as explained above. Finally, the front end of the rear surfboard is secured by tightening the straps or belts 26 and 27, cf. FIG. 3.

The composite or tandem wind-surfer is then ready for use. It may, however, be necessary to trim the wind-surfer by adjusting the longitudinal position of the keel 16.

The coupling means as described can be used for assembling or coupling single surfboards of mutually different type or make.

By using two coupling elements it is possible to assemble three single surfborads together as shown in FIG. 10, whereby one obtains a triple surfboard. In consideration of the mechanical forces that may appear in such a triple surfboard, especially due to its length, the coupling element may comprise front and rear clamping means in another design as shown in FIG. 11.

As shown in FIG. 11 said front and rear clamping means comprise a nut 36, a clamping or washer plate 37 and a drawbolt 38, the lower end of which is shaped as a hook. Said drawbolt is to be inserted down in an opening 40 in the strengthening rib 34, cf. FIG. 11, its hook engaging a transversal pin 41 in said opening 40. The drawbolt is pulled upwards through the daggerboard box 51 of the corresponding single surfboard and then inserted in its clamping plate 37 and tightened by means of the nut 36, cf. FIGS. 13 and 14.

Figure 16:
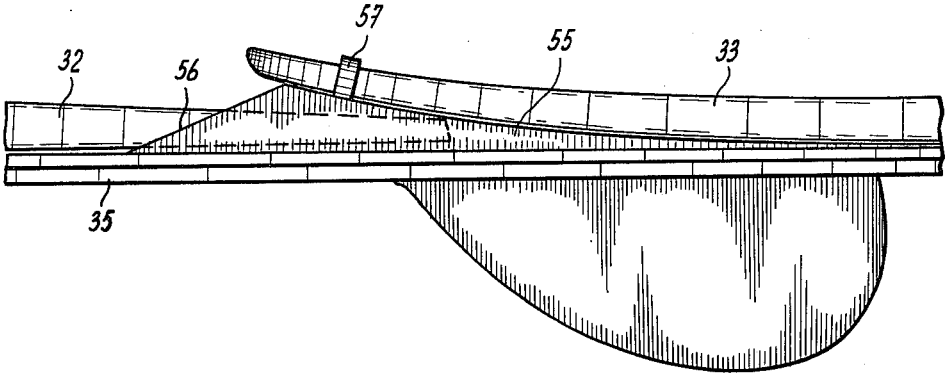

The middle clamping means, shown in FIG. 15, comprises a raised piece 55 shaped with a cavity 56 for the insertion of the rear end of a front surfboard 32, cf. FIG. 16, and a strap 57 to be tightened around the front end of the rear single surfer 33, cf. FIG. 16.

When the surfboard users wish to combine their single surfboard into a triple surfboard unit this can easily be done by using the coupling elements as described and shown below.

The stabilizing fin 10 (FIG. 3) of a tandem surfer is removed. Then the coupling element 35 is located under the surfer 32 and meets coupling element 34 under the middle of the daggerboard box 51. Then, the drawbolts 38 are brought into engagement with their pins 41 and secured by screwing the nuts 36 on their clamping plates or washers 37 on the upper side of surfboard 32, the rear end of the front surfboard 31 (FIG. 10) being inserted in the cavity 56 of coupling element 34, while the rear end of surfboard 32 likewise is inserted in the cavity 56 of the corresponding coupling element 35. After fastening of the nuts 36 at front end and rear end of coupling elements 34 and 35, respectively, the composite or triple surfboard is now ready to sail.

The dimensions of the different parts of the coupling elements such as 34 and 35 are choosen in accordance with the dimensions of the surfboards at their front and rear ends, respectively. E.g. the dimensions of the cavity 56 in the raised piece 55 is choosen so as to fit with the surfboard rear end. The advantage of the raised piece 55 and of the rear end of one surfboard engaging into the cavity 56 is that a continuity is thereby obtained as far as water stream is concerned, whereby whirling is considerably reduced.

I claim:

1. A composite wind surfboard comprised of at least two single surfboards, each having a keel box for receiving a retractable keel, said surfboards being linked together in tandem such that a rear end of a first surfboard is substantially juxtaposed end-to-end to a forward end of a second surfboard, said surfboards being tandemly linked together by means of a substantially rigid elongated linking member disposed along a substantial length of the bottom of said tandemly arranged surfboards and across a tandemly juxtaposed portion of said surfboards in substantially a common horizontal plane, said elongated linking member being coupled by a first vertically extending coupling means at one end thereof to said first surfboard and by a second vertically extending coupling means at its other end to said second surfboard relative to said common horizontal plane, each of said coupling means extending into each of the corresponding keel boxes of said surfboards, and wherein said elongated linking member has in substantially the middle thereof fastening means for coupling said surfboards in a tandem-juxtaposed relationship.

2. The composite wind surfboard of claim 1, wherein said elongated linking member has a planar upper surface, said elongated linking member tapering from its middle towards its opposite ends, and wherein said elongated linking member has a strengthening rib which runs along the length of its underside.

3. The composite wind surfboard of claim 1, wherein said first and second coupling means of said elongated linking member comprise an upstanding plate dimensioned to extend into each of the corresponding keel boxes of said surfboards.

4. The composite wind surfboard of claim 3, wherein each of said upstanding plates have oppositely disposed notches around which is fastened elastic means attached to holding means for effecting clamping of the ends of the elongated linking member to the corresponding surfboard when said upstanding plate and holding means are inserted through the corresponding keel box to lockingly engage said elongated means to each of said surfboards.

5. The composite wind surfboard of claim 3, wherein the fastening means for coupling said at least two surfboards together also include straps which connect the juxtaposed ends of the surfboards together, elastic protective means being located between the two ends of said surfboards.

6. The composite wind surfboard of claim 1, wherein said at least two surfboards comprise said first and second surfboards and a third surfboard arranged in tandem, wherein said elongated linking member and a second elongated linking member are employed coupling the surfboards together, which elongated members meet in end-to-end relationship beneath the keel box of the second surfboard, the first elongated linking member being connected to said first and second surfboards via drawbolts passing through each end of said first elongated member and each keel box of said first and second surfboards and lockingly engaging the first elongated member to said surfboards, the second elongated member being similarly coupled to the second and third surfboards, whereby the three surfboards are rigidly held together.

7. The composite wind surfboard of claim 1, wherein in the approximate middle of said elongated linking member a raised pedestal is provided having a cavity into which one end of said first surfboard is engaged, said pedestal also having a surface upon which one end of said second surfboard is firmly supported and clamped thereto.

8. The composite wind surfboard of claim 1, wherein said elongated linking member has a keel accommodating slot therein including a keel adjustably mounted therein.

9. The composite wind surfboard of claim 1, wherein said elongated linking member is composed of an epoxy-fiber glass composition containing within it foam material.

10. The composite wind surfboard of claim 1, wherein said elongated linking member is made of wood.

11. A composite wind surfboard comprised of at least two single surfboards, each having a keel box for receiving a retractable keel, said surfboards being linked together in tandem such that a rear end of a first surfboard is substantially juxtaposed to a forward end of a second surfboard, said surfboards being tandemly linked together by means of a substantially rigid elongated linking member having a planar upper surface which contacts the bottom of said composite wind surfboard, said elongated linking member having a strengthening rib which runs along the underside of said elongated linking member, said elongated linking member tapering towards its opposite ends from its middle, said elongated linking member being disposed along a substantial length of the bottom of said tandemly arranged surfboards and across a tandemly juxtaposed portion of said surfboards, said elongated linking member being coupled at its ends to said surfboards via clamping means each in the form of an upstanding plate at each end of said elongated member and dimensioned to extend into each of the corresponding keel boxes and to be lockingly engaged thereto, said elongated linking member also having at approximately its middle fastening means for coupling said surfboards in a tandem-juxtaposed relationship.

* * * * *